United States Patent [19]

Nakamura et al.

[11] 4,306,410

[45] Dec. 22, 1981

[54] STRING CONSTRUCTION FOR ATHLETIC RACKETS

[75] Inventors: Masaaki Nakamura; Hisaaki Ueba, both of Mibu, Japan

[73] Assignees: Kureha Kagaku Kogyo Kabushiki Kaisha, Tokyo; Kureha Gosen Kabushiki Kaisha, Tochigi, both of Japan

[21] Appl. No.: 205,911

[22] Filed: Nov. 12, 1980

[51] Int. Cl.[3] ..... D02G 3/34; D02G 3/36; D02G 3/38

[52] U.S. Cl. ..... 57/234; 57/7; 57/207; 428/377

[58] Field of Search ..... 57/206, 207, 210, 225, 57/230, 234, 251, 7.13; 428/360, 375, 377, 378, 400

[56] References Cited

U.S. PATENT DOCUMENTS

| | | | |
|---|---|---|---|
| 2,217,826 | 10/1940 | Van Laer | 57/210 X |
| 3,207,652 | 9/1965 | Shannon | 428/378 X |
| 3,458,987 | 8/1969 | Ozawa et al. | 57/210 |
| 3,644,866 | 2/1972 | Deardurff | 428/377 X |
| 3,745,756 | 7/1973 | Crandall | 57/234 |
| 4,016,714 | 4/1977 | Crandall | 57/234 |

*Primary Examiner*—Donald Watkins
*Attorney, Agent, or Firm*—Wegner & Bretschneider

[57] ABSTRACT

A string construction for athletic rackets which can be frictionally engaged with a tennis ball or a badminton shuttlecock very well upon hitting it and which can be uniformly stretched on the athletic racket frame without being twisted, comprises a string-like core made of thermoplastic resin material and a tubular netlike structure made of thermoplastic resin material, the tubular netlike structure netting over and being secured to an outer circumference of the core, wherein the netlike structure includes a plurality of thread-like members forming a plurality of nodes at intersections thereof, all the thread-like members forming each node being integral with each other at each node, and projecting from the outer circumference of the core to a height substantially equal to each other at each node.

15 Claims, 7 Drawing Figures

STRING CONSTRUCTION FOR ATHLETIC RACKETS

This invention concerns a string construction for athletic rackets and, more specifically, relates to a string construction made of thermoplastic resin for athletic rackets.

A string construction for athletic rackets traditionally used have been prepared from muscles of animals such as sheep and whales by gathering and solidifying them into rigid strands using binders, for example, gelatin. These guts have excellent mechanical properties such as moderate stretching property (easy stretchability on a racket with appropriate tension), relatively high elastic stiffness constants, high elastic limit and less fear of slack during use, and they also present good feelings and comfortable sounds upon hitting a tennis ball and a badminton shuttlecock. The guts of animal muscle origin are, however, extremely poor in water-proofness and much expensive due to the shortage for the resource of the animal strand muscles.

In order to overcome the above drawbacks in the guts of the animal origin, synthetic fiber guts or string construction for athletic rackets have been provided in recent years, which are made from monofilaments or multifilaments mainly of synthetic polyamide fibers by properly twisting and resinifying them, ad are generally used at present. The synthetic fiber guts are superior to the natural guts of animal origin in water proofness, comparable with the latter in the mechanical properties and not so expensive in cost.

The synthetic fiber guts of this type are, however, excessively smooth in their outer surface and, therefore, defective when applied to athletic rackets in that they cannot be preferably frictionally engaged with the ball or the shuttlecock because they are likely to slip over the ball upon hitting it, resulting in disadvantages such as dull trajectory of the ball and difficulties in the ball control such as driving or spinning the ball. In order to give the capability of the better frictional engagement with the ball or to reduce the fear of slips, various countermeasures have been proposed and practiced such as roughening of the outer surface of synthetic fiber monofilaments by grinding with abrasing particles or sand blasting, surface coating of the fibers with frictional substances or rubbery substances, twisting or braiding of the synthetic fiber multifilaments, winding of silk yarns around the synthetic fiber cores, foaming in the surface of the synthetic fibers and the likes. The synthetic fiber guts treated in such manners have, however, poor dimensional stability and are reduced in the stiffness and the limit of elasticity to result in loosening during use. Further, they are inferior also in view of the durability because they often exhibit fluffings or naps, wearings and breakages due to the degradation of the resin, and abrasion, peeling or denaturing of the treating substances. Moreover, since the above-mentioned surface treatments and other treatments are carried out in additional steps separately from the production process for the synthetic fiber filaments, the fabrication cost is increased by so much. A somewhat improved string construction has also been proposed, which is prepared by winding one nylon monofilament or spaced spiral wrap helically in one direction around the outer circumference of a thermoplastic resin core, then winding another nylon monofilament or spaced spiral wrap helically in the opposite direction over the core and said one helical nylon monofilament, and by passing the string thus formed through the nylon formulation and heating chamber a number of times to provide an outer nylon coating over the composite string. However, since the spiral configuration provided by said another nylon monofilament wound around the outer side appears predominantly on the outer surface of the string construction, it is difficult to stretch the string construction on the frame of an athletic racket in a uniform tension.

In addition, there is a fear that the inner and outer spiral monofilaments may not integrally work in the ball control such as bouncing and spinning the ball upon hitting it partly because of the above-mentioned outer configuration of the string construction and partly because the heat treatment after separate formation of the core and the monofilaments will degrade the mechanical properties of the string construction or the monofilaments may not be well cofused to each other. Moreover, as the monofilaments are wound around the core, there will be much variation in the remaining stress in the core depending on the location of the core even before the core is stretched on the athletic racket frame. The string construction might show the gradual creep because of this locally remaining stress in the core when it is attached to the athletic racket frame.

The object of this invention is to provide a string construction made of thermoplastic resin for athletic rackets which can be stretched at a predetermined proper tension without being twisted when it is attached to an athletic racket, which can be frictionally engaged with a tennis ball or a badminton shuttlecock very well upon hitting it and which is less likely to slacken during long use.

The above object of this invention is attained by a string construction for athletic rackets comprising a string-like core made of thermoplastic resin material and a tubular netlike structure made of thermoplastic resin material, said tubular netlike structure netting over and being secured to an outer circumference of said core, wherein said netlike structure includes a plurality of thread-like members forming a plurality of nodes at intersections thereof, all the thread-like members forming each node being integral with each other at said each node, projecting from the outer circumference of said core to a height substantially equal to each other at said each node.

This invention is to be described in more details referring to the accompanying drawings, by which the foregoing and other objects, as well as the features of this invention will be made clearer in which.

Figure 6:
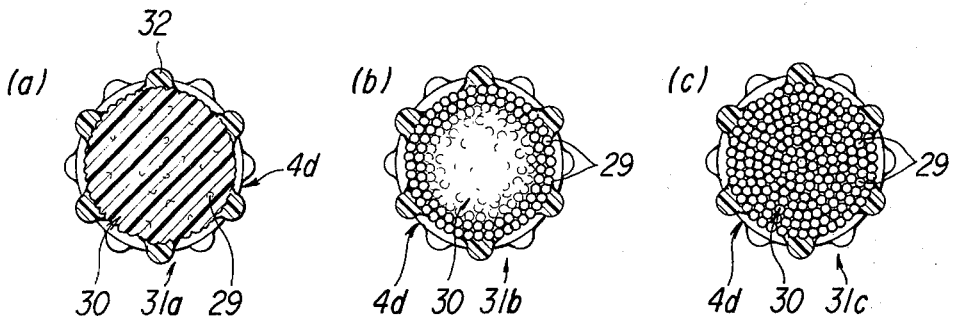
Figure 7:
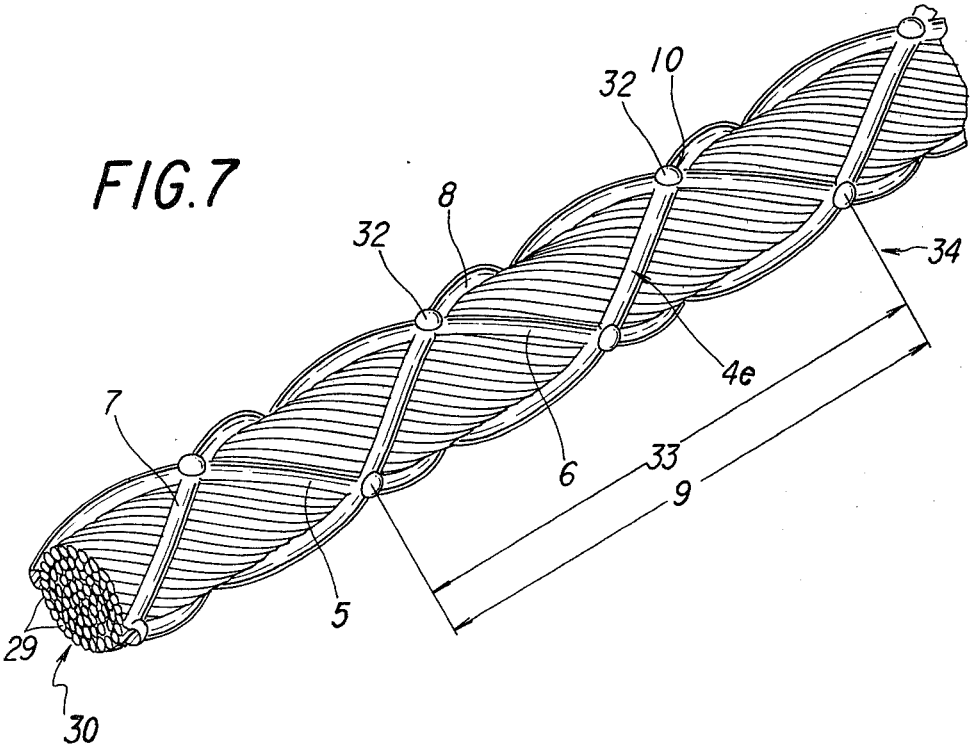

FIGS. 6(*a*), (*b*) and (*c*) are enlarged sectional views of the modifications of the third embodiment of the string construction;

FIG. 7 is an enlarged perspective view of a part of the modified string construction according to this invention.

Figure 1:
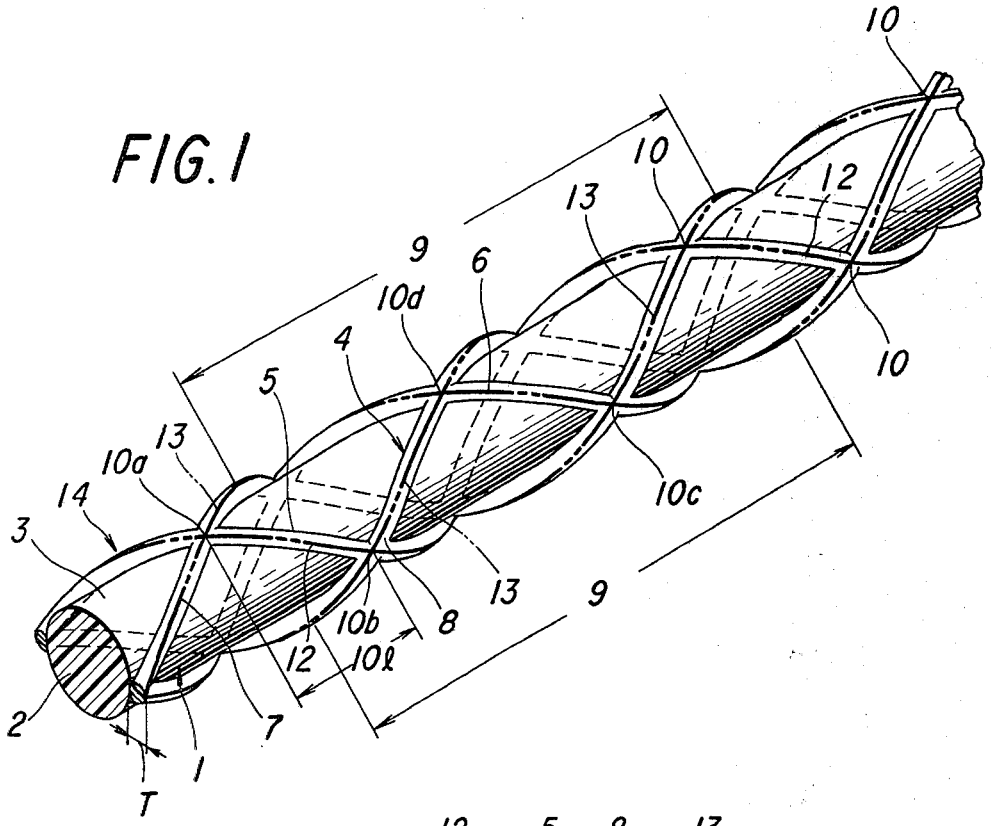
FIG. 1 is an enlarged perspective view of the first embodiment of the string construction for athletic rackets according to this invention.

FIG. 1 shows the string construction for athletic rackets of the first embodiment according to this invention.

Figure 2:
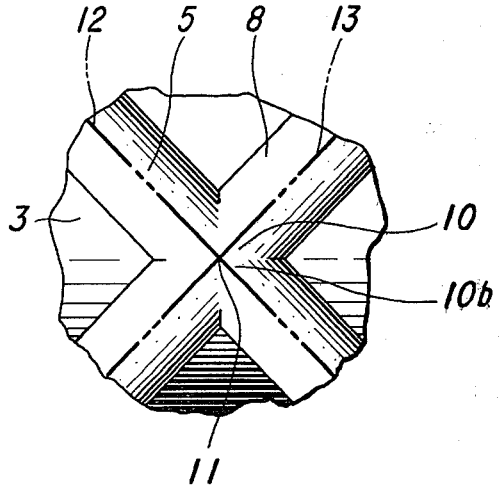
FIG. 2 is an enlarged plan view of the node of the string construction of the first embodiment.

A core 1 comprises a string of a relatively large diameter made of thermoplastic resin. The cross-section 2 of the string 1 is preferably circular, but the cross-section 2 may be formed in other shapes such as an eliptical shape. A tubular net 4 as a tubular netlike or reticulate structure nets over the outer circumference 3 of the core 1. The net 4 is made of thermoplastic resin and is secured to the outer circumference 3. The net 4 comprises fine thread-like members 5, 6 extending helically along the outer circumference 3 of the core 1 like the spiral ridge of a right-handed screw and fine thread-like members 7, 8 extending helically along the other circumference 3 of the core 1 like the spiral ridge of a left-handed screw. The pitch 9 of the helical thread-like members 5, 6 is equal to that of the members 7, 8. Although the pitch for one or more of the thread-like members 5, 6, 7, 8 may be different from that of other thread-like members, it is desired that the pitches of the thread-like members 5, 6, 7, 8 are equal, so that the string construction may not be twisted, when the string construction is stretched on an athletic racket as explained later. The cross-sectional configuration of the thread-like members 5, 6, 7, 8 is circular, eliptic or the like. The diameter of each thread-like member 5, 6, 7, 8 is generally less than one-several of the diameter for the core 1 at the maximum. The number of right-turned or right-handed thread-like members 5, 6 may be smaller or greater than two. The number of left-turned or left-handed thread-like members 7, 8 may also be smaller or greater than two. It is preferred that the number of the right-turned thread-like members is equal to that of the left-turned thread-like members. The net 4 includes a plurality of nodes 10*a* at which the thread-like members 5, 7 intersect or cross with each other and are integrated with each other, a plurality of nodes 10*b* at which the thread-like members 5, 8 intersect or cross with each other and are integrated with each other, a plurality of nodes 10*c* at which the thread-like members 6, 7 intersect or cross with each other and are integrated with each other and a plurality of nodes 10*d* at which the thread-like members 6, 8 intersect or cross with each other and are integrated with each other. The nodes 10*a*, 10*b*, 10*c*, 10*d* have the same structure and they are hereinafter collectively referred to as a node 10. The member 5 or 6 and the member 7 or 8 project to an equal height T at the node 10 where they intersect, from the outer circumference 3 of the core 2. In other words, the center 11 of the node 10 situates at the intersecting point of the projecting top end 12 of the thread-like member 5 or 6 and the projecting top end 13 of the thread-like member 7 or 8. The top end 12 means the radially outermost part of the thread-like member 5 or 6 relative to the thin columnar core 2, that is, the part of the member 5 which is most remote from the outer circumference 3 of the core 2. The top end 12 forms a virtual right-handed helical contour line (alternate long and two short dashes line). While on the other hand, the top end 13 means the radially outermost part of the thread-like member 7 or 8, that is, the part which is most remote from the outer circumference 3 of the core 2. The top end 13 forms a virtual left-handed helical contour line (alternate long and two short dashes line) (refer to the enlarged view of the node 10 in FIG. 2). In other words, the thread-like member 5 or 6 and the thread-like member 7 or 8 extend symmetrically to each other with respect to the node 10, and the thread-like member 5 or 6 and the thread-like member 7 or 8 are not overlapped to each other at the node 10.

The thermoplastic resin used for the core 1 and the net 4 of the string construction 14 for athletic rackets having the foregoing structure is fluorocarbon resin, polyamide resin, or polyester resin depending on the application uses. Fluorocarbon resin, in particular, vinylidene fluoride resin is preferred in view of its relatively high elastic stiffness constants or moduli of elasticity, relatively high elastic limit, water-proofness, chemical resistivity and weather proofness. Synthetic fibers partially including said resins may be used for the core 1 and the net 4. Although the thermoplastic resin for the core 1 may be different from the thermoplastic resin for the net 4, it is desired to form the core 1 and the net 4 with a same type of thermoplastic resin in view of firm adhesion or cofusion between the core 1 and the net 4, weather proofness of the string construction 14 (the mechanical strength of the string construction 14 may be reduced due to the difference in the expansion and contraction between the core 1 and the net 4, which will result from temperature change, etc.). The core 1 and the net 4 may be cofused after they are formed separately. It is preferred to cofuse the core 1 and the net 4 to each other by the remaining heat just after the spinning of the core 1 and the net 4, because the thermoplastic resin is kept oriented in the longitudinal direction of the core 1 and the thread-like members 5, 6, 7, 8 and the string construction 14 has the high moduli of elasticity, high elastic limit and the like.

Figure 3:
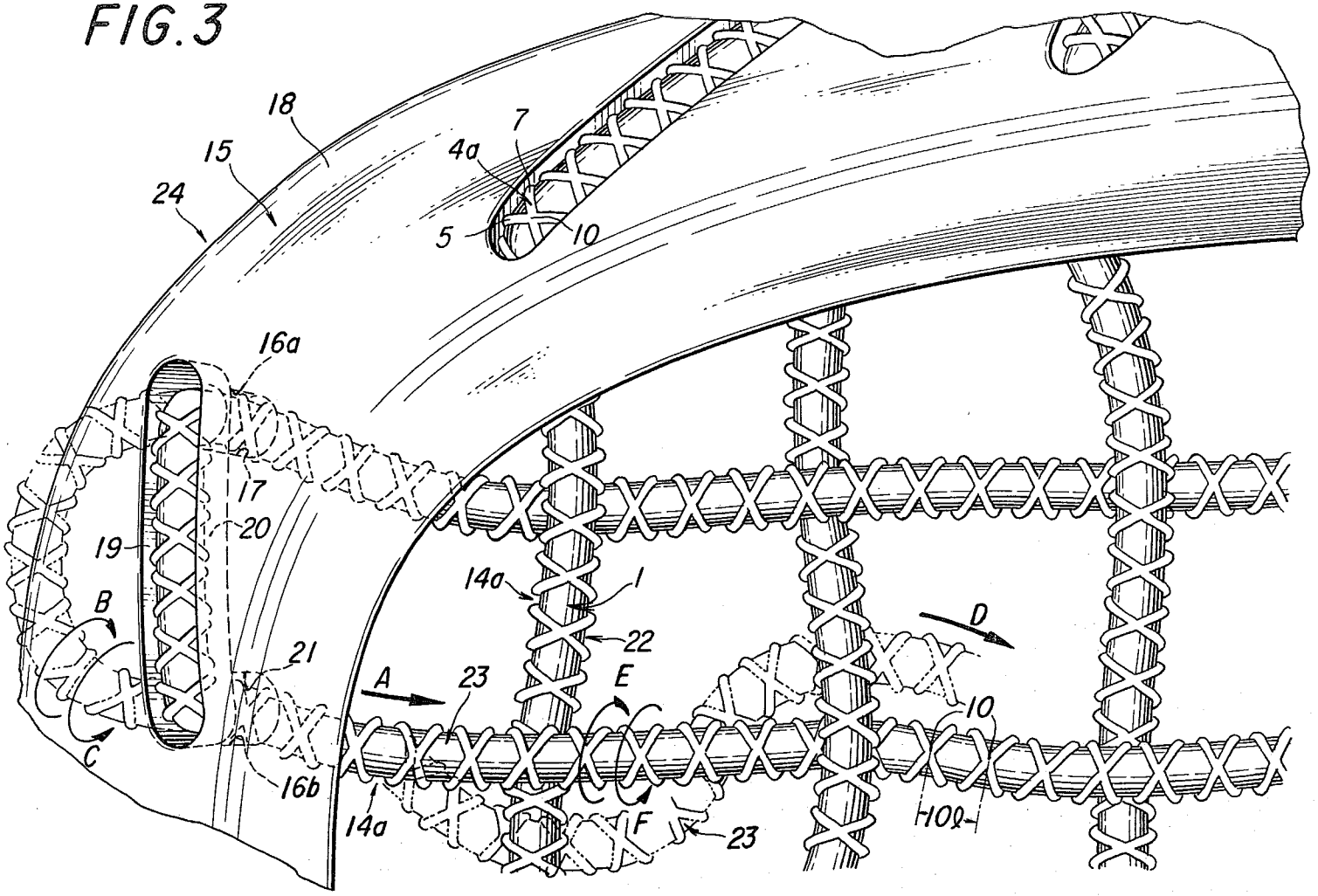
FIG. 3 is an enlarged perspective view of a part of an athletic racket to which the string construction of this invention is applied.

When a string construction 14*a* having a net 4*a* comprising two thread-like members 5, 7 is stretched on a frame 15 of an athletic racket, the string construction 14*a* is passed, for example, through holes 16*a*, 16*b* in the frame 15 and then pulled in the direction A (refer to the alternate long and two short dashes line in FIG. 3). When the string construction 14*a* is pulled in the direction A, the string construction 14*a* is displaced along the inner wall 17 of the hole 16*a*, the bottom wall 20 of the groove 19 formed in the outer circumferential surface 18 of the frame 15 communicating the hole 16*a* with the hole 16*b* and the inner wall 21 of the hole 16*a*. Since the thread-like members 5, 7 extend around the outer circumference of the core 1 helically in opposite directions to each other, preferably, at an equal pitch and secured to the core 1 and since the thread-like members 5, 7 are not radially overlapped to each other at the node 10, the torsion or twisting forces in the direction B and in the direction C which are applied to the string construction 14*a* are almost the same and the string construction 14*a* can be stretched in the holes 16*a*, 16*b* and the groove 19 with the distortion neither in the direction B nor in the direction C.

When a weft 23 or a string construction which extends in the lateral direction of the frame 15 is woven to warps 22 which has been already stretched in the longitudinal direction of the frame 15 over the frame 15, the weft 23 has to be passed in a zig-zag route relative to the warps 22 and pulled in the direction D (refer to the alternate long and two short dashes line in FIG. 3). Since the thread-like members 5, 7 of string construction 14*a* for the warp 22 and the weft 23 extend around helically in opposite directions and are secured to the outer circumference 3 of the core 1 and the thread-like members 5 and 7 are not radially overlapped to each other at the node, the torsion or twisting forces in the direction E and the torsion or twisting force in the direction F are applied substantially uniformly from the warps 22 to the weft 23. Therefore the weft 23 can be stretched without being twisted in the direction E nor in the direction F. Consequently, no local twisting nor torsion is left in the warps 22 and wefts 23 when they are stretched on the frame 15 and the tension of the warps 22 and wefts 23 stretched over the entire area of the frame 15 will be substantially uniform over the entire area of the frame 15. In the athletic racket 24 in which the string constructions 14*a* are stretched as the warps 22 and the wefts 23 on the frame 15, since little or no twisting or torsional stress is left in the warps 22 nor the wefts 23, the string construction 14*a* will be less likely to be degraded in the mechanical or dynamical strength thereof due to creep and the like. In addition, since the tensile stress of the stretched string construction 14*a* varies little according to the stretched location of the frame 15, the resiliency of the string constructions 14*a* for the racket 24 to the tennis ball or the badminton shuttlecock upon hitting it is kept uniform over the entire striking area of the racket 24.

Moreover, since the thread-like members 5, 7 project radially outwardly from the outer circumference 3 of the core 1 to keep the outer surface of the string construction 14*a* for the racket 24 substantially uneven or rough, the string constructions 14*a* can be frictionally engaged with tennis ball or badminton shuttlecock very well for controlling it upon hitting it. That is, since there is little fear of excess slip between the string constructions 14*a* and the ball or suttlecock upon striking it, various ball or shuttlecock control techniques such as cutting, slicing, spinning and driving the ball or shuttlecock can securely be used (the string construction is explained particularly as for tennis rackets for the convenience of the explanation hereinafter). Since the outer surface of the string construction 14, 14*a* is roughened, the intersection of the warp 22 to the weft 23 will be less likely to be displaced. Moreover, since the outer surface of the string construction 14, 14*a* is not injured by the treatment with grinding particles and the likes and not coated with foreign materials such as friction-producing substance and rubbery substances (dislike the conventional string construction), the stretched string construction is less likely to be loose or slack, degree of surface roughness of the string construction 14, 14*a* is less likely to be reduced and it is less likely to be broken or cut.

Although the length 10l between the nearest-neighboring nodes 10, 10 along the longitudinal direction of the core 1 in the string construction 14, 14*a* is different between rackets for tennis balls and shuttlecocks, it is preferred to set the length 10l between 3–30 mm and more suitably, between 5–20 mm. If the length 10l is smaller than 3 mm, degree of the unevenness or the sizes of recess portion formed by the outer surface 3 of the core 1 between the nodes 10, 10 is too small relative to the size of the ball or shuttlecock, whereby the possibility of the slip between the ball or the shuttlecock and the string construction 14, 14*a* may be increased. On the other hand, if the length 10l is larger than 30 mm, twisting or torsional deformation of the weft 23 may possibly be concentrated at a part thereof, when stretching the weft 23 on the frame 15, for example, because only one component, that is, the right-handed thread-like member 5 or 6 (or the left-handed thread-like member 7 or 8), of the string construction 14, 14*a* is mainly forced to the inner wall 17 of the hole 16*a*, inner wall 21 of the hole 16*b* or the warp 22. In the case where the string construction comprises two pairs of the thread-like members 5, 6, 7, 8 as in the string construction 14, it is not always necessary that all of the lengths between the nearest neighboring nodes of the nodes 10*a*, 10*b*, 10*c*, 10*d* along the longitudinal direction of the core 1 are equal to each other but the nodes 10*a*, 10*b*, 10*c*, 10*d* are preferably arranged with an equal distance to each other for the uniform stretching of the string construction 14. Furthermore, as the core 1 is covered with the tubular net 4 or 4*a* in the string construction 14 or 14*a*, there is little fear that the local stresses remain in the core 1.

Figure 4:
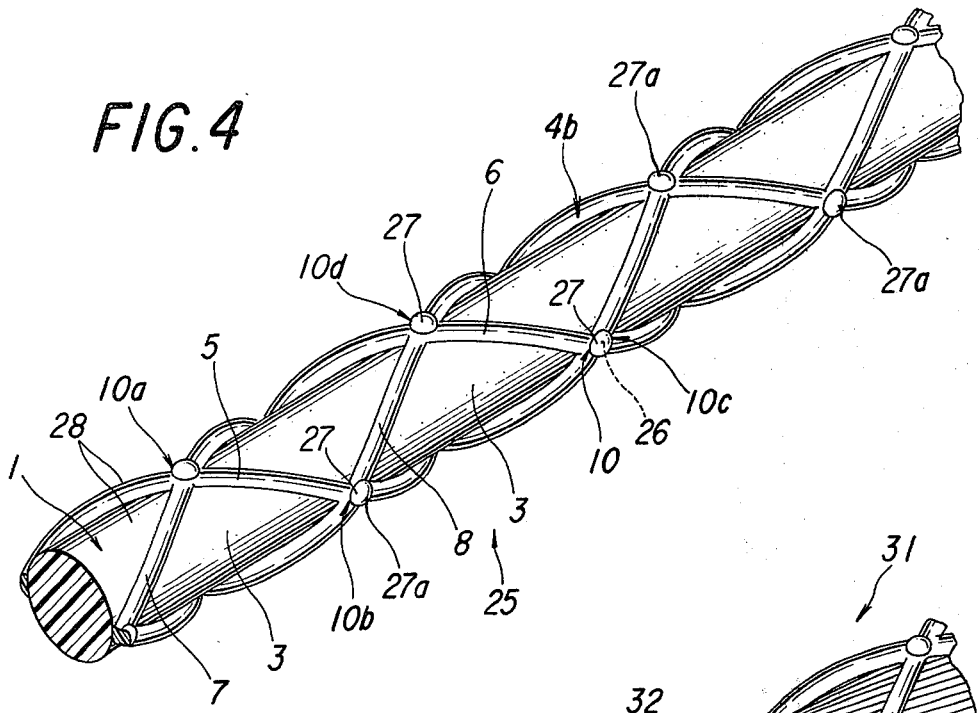
FIG. 4 is an enlarged perspective view of the second embodiment of the string construction for athletic rackets according to this invention.

FIG. 4 shows a string construction 25 for athletic rackets as the second embodiment of this invention. In FIG. 4, the same numerals are given to those parts or portions similar to those in FIG. 1.

The string construction 25 has a net 4*b* in which projections 27 are provided on the outer surface 26 of the node 10. Each projection 27 projects from the node 10 in the radially outward direction of the core 1. Although it is not necessary to provide the projections 27 to all of the nodes 10, they are preferably provided so as to uniformly distribute over the outer surface of the string construction 25. For example, the projections 27 are provided to the outer surface 26 for at least one of the nodes 10*a*, 10*b*, 10*c*, 10*d*. The projection 27 has a configuration such as of semi-spherical or frust-conical shape and the projected end 27*a* of the projection 27 preferably has a convexed curved surface. The projection 27 is integrally connected at its base to the outer surface 26 of the node 10 and it may be greater than the outer surface 26. That is, the base may be partially connected integrally to the outer surface 3 of the core 1 around the node 10 and to the thread-like members 5, 6, 7, 8 near the node 10. In addition to the advantageous features of the string construction 14 or 14*a* as described above, the string construction 25 has further improved capabilities of frictional engagement with balls or shuttlecocks. Specifically, since the string construction 25 has the projections 27, the outer surface 28 of the string construction 25 is further roughened as compared with the outer surface of the string construction 14 or 14*a*. Consequently, the projections 27 can intrude into the ball even when the impact given to the tennis ball is relatively small, the ball is less deformed upon hitting it, and only the plurality of projections 27 are actually abutted against the ball. Therefore there is little fear of the slip between the ball and the string construction 25 and the ball control such as driving, spinning, slicing and the like can be more surely done.

Figure 5:
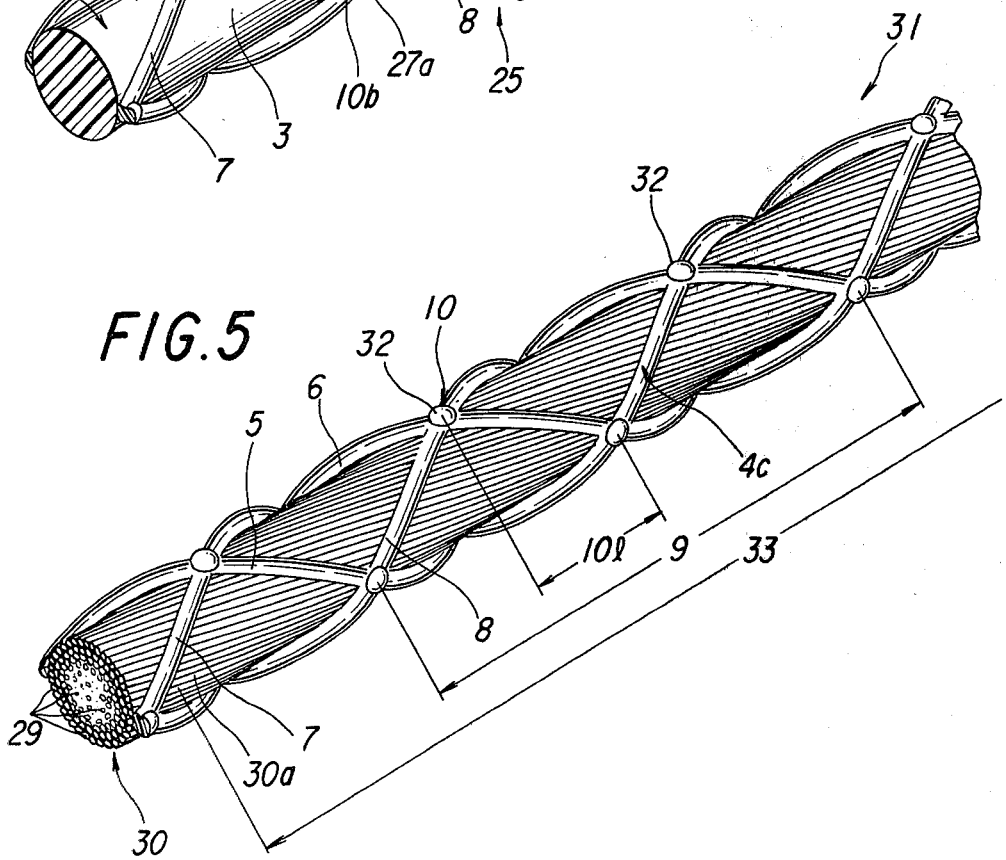
FIG. 5 is an enlarged perspective view of the third embodiment of the string construction for athletic rackets according to this invention.

FIG. 5 shows a string construction 31 as the third embodiment of this invention, in which a plurality of monofilaments 29 are uniformly twisted in one direction (at a predetermined pitch) and the monofilaments 29 are cofused to each other to form a core 30. The net 4*c* of the string construction 31 has the same projections 32 as in the net 4*b* of the string construction 25, and the net 4*c* is cofused to the core 30.

The pitch 33 of the twisted monofilaments 29 is made larger than the pitch 9 for the helical thread-like members 5, 6, 7, 8 and the net 4*c* is of a substantially cylindrical contour in spite of the unevenness present in the outer surface 30*a* of the core 30. Although the pitch 9 may be greater than the pitch 33 for maintaining the net 4*c* substantially in a cylindrical configuration, the pitch 33 is preferably made greater than the pitch 9. This is because it is desired to avoid the excess twisting of the monofilaments 29 and the fluffings or naps over the surface 30*a* of the core 30 due to the excess twisting of the monofilaments 29 at the core 30 which is situated nearer to the twisting center than the net 4*c* and to avoid that the distance 10l between the nodes 10, 10 in the net 4*c* becomes too large. Although the monofilaments 29 constituting the core 30 may be several in number, it is preferred that the core 30 comprises a greater number of monofilaments, for example, more than several tens in order to maintain the cylindrical configuration of the core 30.

If the pitch 33 of the twisted monofilaments 29 constituting the core 30 is too large, the warp (or the weft) is likely to slide or slip over the weft (or the warp) at their intersection. On the other hand, if the pitch 33 is too small, degree of the roughness in the outer surface 30*a* of the core 30 becomes too large, which may possibly result in fluffings or naps in the outer surface 30*a* in a relatively short period of use. Accordingly, the pitch 33 for the core 30 is appropriately determined depending on the thermoplastic materials and the uses of the string construction 31.

Since the core 30 is composed of a plurality of uniformly twisted monofilaments 29 which are cofused to each other in the string construction 31, the string construction 31 has advantages in that the string construction 31 is less likely to become slackened during long use and in that degree of the roughness of the outer surface thereof is further enhanced, in addition to having the foregoing advantageous features of the string constructions 14, 14*a* and 25. Although the monofilaments 29 constituting the core 30 may be cofused to each other to such an extent or degree, as shown in FIG. 6(*a*) where the circular contour for each of the monofilaments 29 is almost lost, it is preferred that each of the monofilaments 29 is partially cofused or secured as shown in FIG. 6(*b*) or FIG. 6(*c*) in order to provide the core 30 with uniform and improved mechanical properties (high elastic stiffness constants, high elastic limit and less fear of creep, etc.) at each of the portions in the longitudinal direction of the core 30 and to avoid the core 30 being slackened. Even in this case, since the core 30 is cofused or secured to the tubular net 4*c* in the string construction 31, the monofilaments 29 will not be untwisted. In FIGS. 6(*a*), (*b*) and (*c*), the string constructions 31*a*, 31*b*, 31*c* are exemplified as having a net 4*d* comprising six left-handed thread-like members and six right-handed thread-like members. Cofusion among the monofilaments 29 and the cofusion between the core 30 consisting of the monofilaments 29 and the net 4*c*, 4*d* are preferably conducted by utilizing the remaining heat just after the melt extrusion and spinning of the thermoplastic resin for the production of the core 30 consisting of the monofilament 29 and the net 4*c* or 4*d*.

FIG. 7 shows a string construction 34 in which the pitch 33 of the twisted monofilaments 29 and the pitch 9 of the helical or spiral thread-like members 5, 6, 7, 8 are equal to each other. The string construction 34 has the same structure as that for the string construction 31, 31*a*, 31*b*, 31*c* excepting that the thread-like members 5, 6, 7, 8 are preferably made sufficiently thicker than the monofilaments 29 of the string construction 31 so that the net 4*e* comprising the thread-like members 5, 6, 7, 8 is substantially cylindrical or tubular.

The percent elongation at rupture of the string constructions 14, 14*a*, 25, 31, 34 made of the thermoplastic resin (the value in percentage obtained by dividing the elongation of the string construction upon rupture by the original length of the same string construction under no tensile force) is, preferably, between 15 and 50%. The thermoplastic resin material which has a small elongation at rupture usually has large elastic stiffness constants. If the percent elongation at rupture of the string construction is smaller that 15%, it is difficult to stretch the string construction on the frame of the racket at a desired tension and, even if it can be stretched on the racket frame in such tension, the repelling force to a tennis ball upon hitting the ball is too great and the string construction may be cut off upon hitting the ball. While on the other hand, a thermoplastic resin material which has a large elongation at rupture usually has small elastic stiffness constants, and small elastic limit and the creep is likely to occur in this type of thermoplastic resin material. If the percent elongation at rupture of the string construction is larger than 50%, the repelling force to the ball upon hitting the ball is too small and the string construction is likely to slacken.

What is claimed is:

1. A string construction for athletic rackets comprising a string-like core made of thermoplastic resin material and a tubular netlike structure made of thermoplastic resin material, said tubular netlike structure netting over and being secured to an outer circumference of said core, wherein said netlike structure includes a plurality of thread-like members forming a plurality of nodes at intersections thereof, all the thread-like members forming each node being integral with each other at said each node, and projecting from the outer circumference of said core to a height substantially equal to each other at said each node.

2. The string construction of claim 1, in which the core and the network structure are secured by cofusion.

3. The string construction of claim 2, in which each of the nodes is formed at the intersection of two thread-like members.

4. The string construction of claim 3, in which each of the thread-like members extends helically along the outer circumference of the core and has a pitch equal to each other.

5. The string construction of claim 4, in which the nodes are distributed uniformly over the outer circumference of the core.

6. The string construction of claim 5, in which at least a part of the nodes have projections, each projection projecting radially outwardly from the string construction, and the nodes having projections are distributed uniformly over the outer circumference of the core.

7. The string construction of claim 6, in which each node has the projection.

8. The string construction in any one of claims 1 to 7, in which the core comprises a plurality of monofilaments twisted and secured to each other.

9. The string construction of claim 8, in which the monofilaments are secured by cofusion.

10. The string construction of claim 9, in which the cofusion among the monofilaments in a central part of the core proceeds much more than cofusion among the monofilaments in a peripheral part of the core.

11. The string construction of claim 9, in which a pitch of the twisted monofilaments is different from the pitch of the helical thread-like members.

12. The string construction of claim 9, in which a diameter of each monofilament is smaller than a diameter of each thread-like member and the pitch of the twisted monofilaments is equal to the pitch of the helical thread-like members.

13. The string construction of claim 9, in which the thermoplastic resin material is a resin selected from the group consisting of fluorocarbon resins polyamide resins and polyester resins.

14. The string construction of claim 13, in which the thermoplastic resin materil is a vinylidene fluoride resin.

15. The string construction of claim 14, in which the percent elongation at rupture thereof is from 15 to 50%.

* * * * *